United States Patent [19]

Stutzman

[11] Patent Number: 4,525,953

[45] Date of Patent: Jul. 2, 1985

[54] WEATHER SEAL WITH WIDE RANGE OF FLEXURE

[76] Inventor: Ellis D. Stutzman, 8070 Meade St., Westminster, Colo. 80030

[21] Appl. No.: 542,008

[22] Filed: Oct. 14, 1983

[51] Int. Cl.[3] ..... E06B 7/16

[52] U.S. Cl. ..... 49/488; 49/197; 49/493; 49/496; 160/209

[58] Field of Search ..... 49/488, 493, 494, 496, 49/197; 160/201, 209

[56] References Cited

U.S. PATENT DOCUMENTS

| | | | |
|---|---|---|---|
| 50,016 | 9/1865 | Lynch | 49/493 |
| 573,683 | 12/1896 | Moseley | 49/480 |
| 1,949,193 | 2/1934 | Verhagen | 49/488 |
| 2,718,678 | 9/1955 | Ramsay | 49/496 X |
| 2,863,504 | 12/1958 | Schlytern | 160/201 |
| 3,023,804 | 3/1962 | Howell | 49/488 X |
| 3,090,427 | 5/1963 | Strap et al. | 160/209 X |
| 3,354,934 | 11/1967 | Stansberry | 160/209 |
| 3,511,301 | 5/1970 | Graham et al. | 160/209 |
| 3,543,441 | 12/1970 | La Porte | 49/488 X |
| 3,854,247 | 12/1974 | Stark et al. | 49/496 |
| 4,001,974 | 1/1977 | Wright | 49/488 |
| 4,356,856 | 11/1982 | Bengtsson | 160/209 |

FOREIGN PATENT DOCUMENTS

| | | | |
|---|---|---|---|
| 507465 | 11/1954 | Canada | 49/488 |

*Primary Examiner*—Philip C. Kannan

*Attorney, Agent, or Firm*—Fields, Lewis, Pittenger & Rost

[57] ABSTRACT

A weather seal disclosed is particularly effective in providing a seal for uneven gaps of substantial width and length such as are found along the bottom of a garage door. The weather seal is a unitary extruded strip including a base section (21) mounted on the door, a resilient arm section (22) extending away from the base section and an end section (23) extending from the arm section opposite and in spaced relation to the base section. A lip section (24) extends away and down from the rear of the base section (21). In use, the arm section 22 flexes to resiliently urge the end section against a surface (14) so as to provide a substantially constant loading throughout the full extent of the door. For metal doors (31) a retainer (32) fastens to the door which in turn receives a portion of the seal and holds it in position for operation on the metal door.

7 Claims, 8 Drawing Figures

WEATHER SEAL WITH WIDE RANGE OF FLEXURE

TECHNICAL FIELD

This invention relates to a novel and improved weather seal for a movable door that is particularly suitable for closing the non-uniform gap along the bottom of an overhead garage door.

BACKGROUND ART

Non-uniform or uneven gaps occur between various types of doors and opposite stationary surfaces and in particular at the bottom of overhead garage doors. Overhead garage doors frequently have an uneven gap that is usually narrower at the center and wider at the ends due to a sagging door or having the concrete garage floor heave. There is a need for an effective weather seal suitable for preventing cold air, snow, water and the like from entering the garage along the bottom of a garage door.

A weather seal now in use for this purpose includes a base section that is secured to the bottom edge of the door and a resilient flap-like section that extends at an angle down and away from the base section. This seal has a limited range of flexure so that in many instances it does not close the gap particularly at the ends.

Howell , U.S. Pat. No. 3,023,804 discloses a flap that extends fowardly from a forward portion of a base section secured to the door. LaPorte, U.S. Pat. No. 3,543,441, has a flexible V-shaped bottom portion on a weather seal.

Moseley, U.S. Pat. No. 573,683 is an example of an early form of weather strip on the bottom of a conventional wooden door with a portion that extends back under the door.

A variety of weather seals have been provided for doors of motor vehicles, such as U.S. Pat. Nos. to Ramsay, 2,718,678, Stark et al. 3,854,247, and Wright 4,001,974. These weather seals are not concerned with fully closing the uneven gaps of considerable width and length such as those found between the bottom of a garage door and the opposite floor surface.

DISCLOSURE OF INVENTION

A weather seal disclosed has a base section that is secured to the bottom edge of a garage door and a resilient arm section of considerable dimension to provide a wide range of flexure extending away from an end portion of the base section and back and under the door to resiliently urge an end section against the floor surface. The end section extends back from the arm section at an acute angle and, with the door in a closed position, the arm section provides a substantially constant loading of a sealing surface in engagement with the floor surface for the full extent of the garage door.

BRIEF DESCRIPTION OF DRAWINGS

The details of this invention will be described in connection with the accompanying drawings, in which.

DETAILED DESCRIPTION

Figure 1:
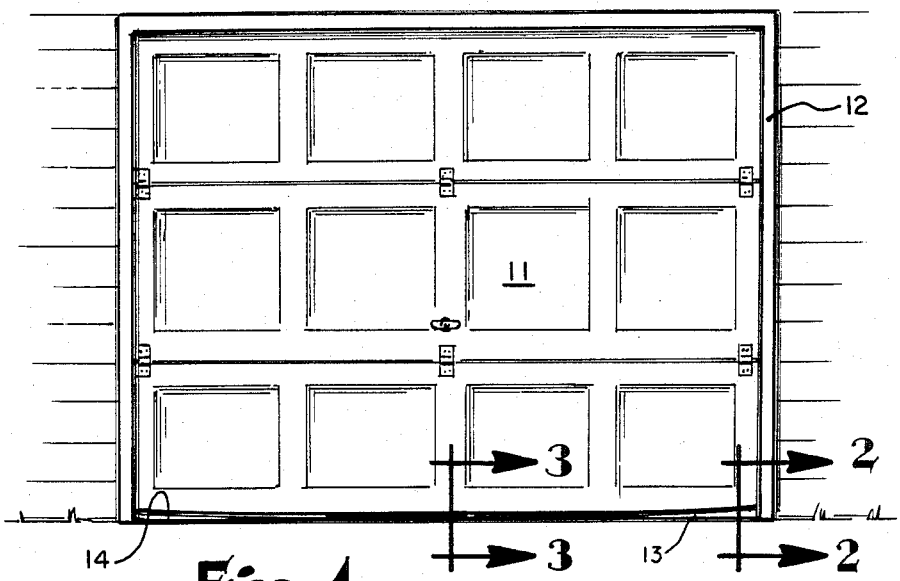
FIG. 1 is a front elevational view of a garage door having a weather seal embodying features of the present invention.

Referring now to the drawings, there is shown a garage door 11, in a closed position in a door frame 12 with the door having a weather seal 13 mounted thereon. The weather seal 13 is mounted on the bottom edge surface of the garage door and is in sealing engagement with the garage floor surface 14. Typically, the central portion of the garage door sags so there is an uneven gap between the garage door and the floor surface. This gap is usually narrower at the central area and wider at the ends as shown. Garage doors are usually eight feet or sixteen feet in length.

The weather seal 13 shown is a one-piece, unitary elongated body or strip of substantially the same length as the bottom edge of the door having a base section 21, a resilient intermediate arm section 22 that extends away from the forward end portion of the base section and an end section 23 extends from the arm section and is disposed opposite and in spaced relation to the base section at an acute angle to the base section. This angle for the seal shown is about 40°. The weather seal shown further includes a lip section 24 that extends away and down from the rear end portion of the base section at an angle and increases the strength of the base section. The end and arm sections extend along a single continuous curve.

Figure 2:
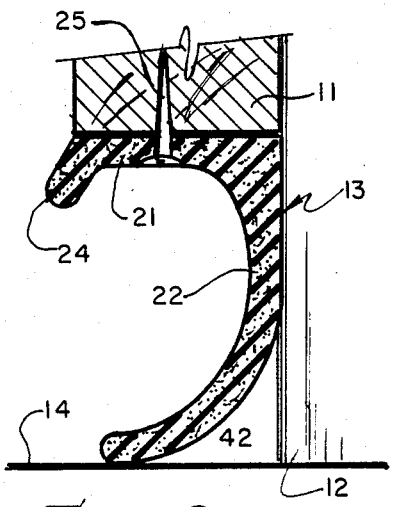
FIG. 2 is a sectional view taken along lines 2—2 of FIG. 1.

The base section 21 is readily secured to the bottom of the door 11 which is shown as wood in FIG. 2, preferably with a plurality of nail-type fasteners 25 at spaced intervals along the door. The base section extends the full length of the bottom rail. The intermediate arm section 22 is of sufficient extent to cover the entire gap, which may be up to two inches at the ends in some garage door installations. This substantial length of the arm section 22 provides a wide range of substantial flexure for the end section 23.

Figure 3:
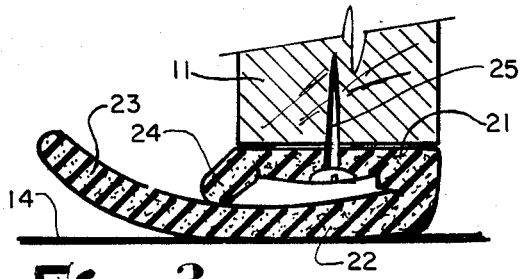
FIG. 3 is a sectional view taken along lines 3—3 of FIG. 1.
Figure 4:
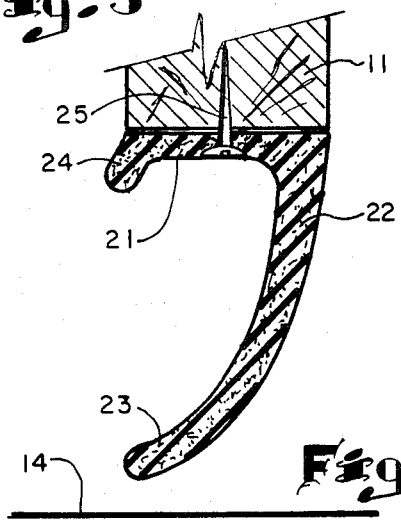
FIG. 4 is a side elevational view showing the garage door raised from the floor surface and with the weather seal in an unflexed position and the actual size as extruded.

In use, the arm section is movable from an unflexed position substantially normal to the base section as shown in FIG. 4 to a fully flexed or compressed position as shown in FIG. 3 where the arm section is substantially parallel to the base section in urging the sealing section along a wide range of gap dimensions.

The extent of the arm section 22 and the end section 23 change along the uneven gap. As shown in FIG. 2, at the ends where the extent of the gap is greatest the area of the sealing surface of the end section in contact with the floor surface is the least and the flexure and the tension exerted by the arm section is the least. As shown in FIG. 3 at the central area where the extent of the gap is the least the area of the sealing surface is greatest and the flexure and tension is greatest. In this way, the loading provided by the resilient intermediate arm section in pounds per square inch is substantially constant throughout the extent of the end section in contact with the floor surface which results in a highly effective weather seal.

The weather seal 13 is made of a weather resistant material and is an extruded closed cell structure with a skin surface. A material found particularly suitable is a blend of ethylene, propylene and terpolymer referred to as EPT No. RE-42-43 manufactured by Rubatex Corporation of Bedford, Va.

Figure 5:
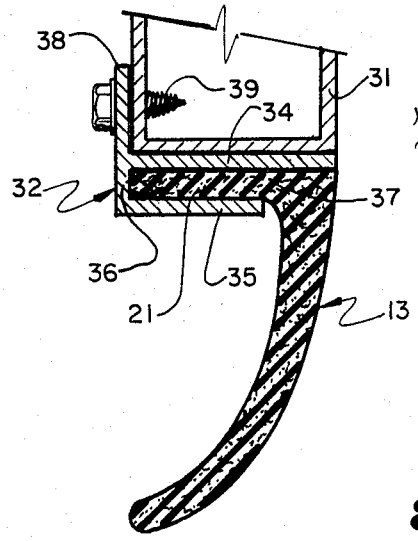
FIG. 5 is a side elevation of the weather seal shown in FIGS. 1–4 mounted on a metal garage door.

Referring now to FIG. 5 there is shown a metal garage door 31 on which there is mounted a retainer 32 which in turn carries the weather seal 13 above described. The retainer 32 includes a channel-shaped portion comprising an upper leg 34 that extends along the bottom of the door and a lower leg 35 spaced from the lower edge with a connecting leg 36 and providing a channel opening 37 facing toward the front of the door. A flange 38 extends up from the connecting leg 36. A plurality of fasteners 39 such as bolts are threaded through holes in the flange and door to secure the retainer to the door. The retainer 32 is coextensive with the bottom edge of the door. The base section 21 together with lip section 24 are inserted through the opening 37 into the channel and retained therein as by the use of an adhesive.

In view of the sealing effect provided all along the bottom of the garage door by the weather seal 13 as above described, the weather seal of the present invention is an effective energy saving device. As is noted in FIG. 2 a portion of the front of the door section 22 presses against the door frame 12 to seal a portion at the ends of the door. There is, however, a crescent-shaped spaced indicated at 42 at each end of the seal between the seal, floor surface and door frame 12.

Figure 6:
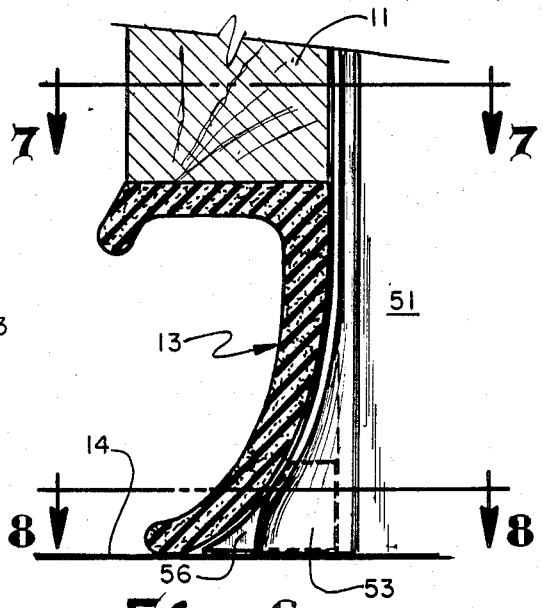
FIG. 6 is a sectional view of the weather seal shown in FIG. 2 with an edge seal and an end closure.
Figure 7:
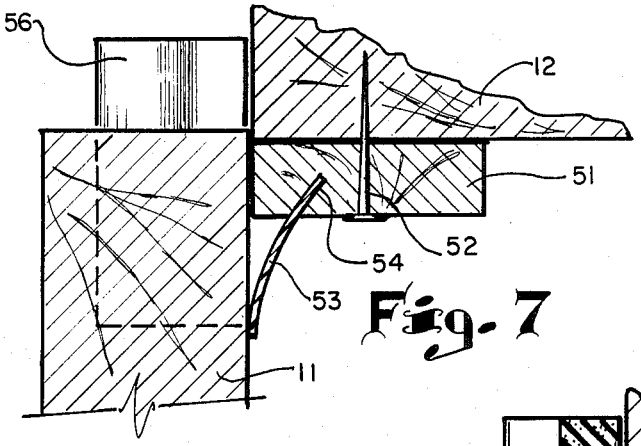
FIG. 7 is a sectional view taken along lines 7—7 of FIG. 6.
Figure 8:
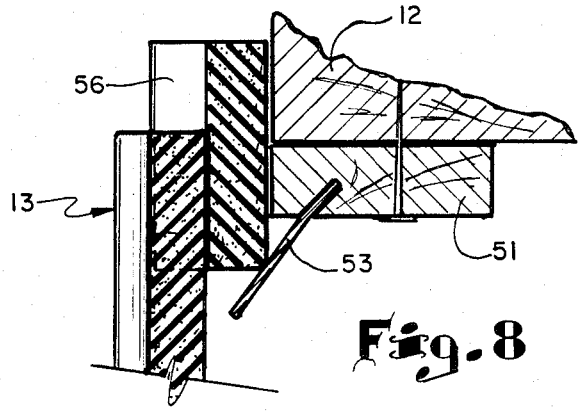
FIG. 8 is a sectional view taken along lines 8—8 of FIG. 6.

Referring now to FIGS. 6–8 there is shown a construction used in connection with garage doors to further seal gaps between the door 11 and frame 12 which includes trim strip or molding 51 that fastens to the frame as by nails 52 and has a resilient flap 53 held in a skewed slot 54 in the molding and extending out from the molding at an angle to the exterior surface thereof. This molding 51 extends along the sides and top of the door and in conjunction with the weather seal above described forms a good seal around the entire periphery of the garage door. To seal the crescent-shaped space 42 a flexible insert 56 which may be a foam rubber is placed in this space 42 and is of a size to engage the seal section, floor surface and resilient flap 53 so as to substantially close the ends and seal the ends of the garage door at the bottom thereof where space 42 formerly existed.

Although the present invention has been described with a certain degree of particularity, it is understood that the present disclosure has been made by way of example and that changes in details of structure may be made without departing from the spirit thereof.

What is claimed is:

1. A weather seal for the bottom of an overhead garage door having an uneven gap between the door and the floor surface comprising a one-piece unitary body of a resilient weather-resistant material that is an extruded, closed cell structure with a skin surface that will not harden during cold weather conditions, said body extending the full length of the door and including:

a base section secured to and extending under an edge surface of a door substantially the full front to rear extent thereof;

a resilient arm section extending down from and substantially normal to a forward end portion of said base section; and a downwardly and rearwardly inclined end section extending from said arm section disposed opposite and in spaced relation to said base section at an acute inside angle of less than 45° to said base section, said arm section being flexed as the door is closed to resiliently urge said end section against the stationary surface, the length of said arm section being approximately the same as the length of said base section and the combined length of said arm and end sections being approximately twice the length of said base section to provide a wide range of flexure and provide a substantially constant loading of a sealing surface in contact with the stationary surface throughout the extent of the door edge surface, said arm section being movable from an unflexed position substantially normal to said base section to a fully flexed position substantially parallel to said end section along a wide range of gap dimensions.

2. A weather seal as set forth in claim 1 wherein the extent of arm section beyond the base section is selected in relation to the extent of the gap to provide a range of substantial flexure for said sealing section.

3. A weather seal as set forth in claim 1 wherein said end and arm sections all extend along a single continuous curve.

4. A weather seal as set forth in claim 1 further including a lip section extending from an end portion of said base portion opposite said arm section to increase the strength of said base section.

5. A weather seal as set forth in claim 1 wherein said base portion is secured to the bottom of a wooden garage door by fasteners.

6. A weather seal as set forth in claim 1 including a retainer fastened to a metal garage door having opposed legs and a connecting leg forming an open channel into which the base section is inserted and held with said arm section projecting from an opening in said channel, a flange extending up from said connecting leg through which fasteners extend to secure said retainer to the metal garage door.

7. A weather seal for the bottom of an overhead garage door having an uneven gap between the door and the surface comprising a one-piece unitary body of resilient, weather resistant material that is an extruded closed cell rubber-type structure made of a blend of ethylene, propylene, and terpolymer that will not harden in cold weather, extending the length of the door including:

a base section secured to and extending under the bottom of a garage door for substantially the full front to rear extent thereof;

a lip section extending rearwardly and downwardly from said base section;

a resilient intermediate arm section extending down from and substantially normal to a forward end portion of said base section, said arm section being of a dimension in relation to the gap to provide a wide range of flexure and close said gap; and a downwardly and rearwardly inclined end section extending back from said arm section below and in spaced relation to said base section at a relatively sharp acute inside angle of less than 45°, said arm section being flexed as the door is closed to resiliently urge said end section against the floor surface, the length of said arm section being approximately the same as the length of said base section and the combined length of said arm and end sections being approximately twice the length of said base section to provide a wide range of flexure and provide a substantially constant loading of a sealing surface in contact with the floor surface throughout the length of the door, said arm section being movable from an unflexed position substantially normal to said base section to a fully flexed position substantially parallel to said base section in urging said end section along a wide range of gap dimensions.

* * * * *